US006419713B1

(12) United States Patent
Durand et al.

(10) Patent No.: US 6,419,713 B1
(45) Date of Patent: Jul. 16, 2002

(54) FUEL COMPOSITION PRODUCING A COLORED FLAME

(75) Inventors: Gérard Durand, Le Pecq; Bandombélé Mokili, Nantes; Jean-Pierre Rives, Paris; Bruno Legrand, Antibes, all of (FR)

(73) Assignee: Regal Universal Ltd., Isle of Man (IL)

( * ) Notice: Subject to any disclaimer, the term of this patent is extended or adjusted under 35 U.S.C. 154(b) by 0 days.

(21) Appl. No.: 09/600,741

(22) PCT Filed: Jan. 19, 1999

(86) PCT No.: PCT/BE99/00005

§ 371 (c)(1),
(2), (4) Date: Jan. 5, 2001

(87) PCT Pub. No.: WO99/37743

PCT Pub. Date: Jul. 29, 1999

(30) Foreign Application Priority Data

Jan. 22, 1998 (BE) ..... 9800047

(51) Int. Cl.[7] ..... C10L 7/00; C11C 5/00

(52) U.S. Cl. ..... 44/265; 44/275; 44/317; 431/126; 431/188

(58) Field of Search ..... 44/275, 265, 317; 431/126, 288

(56) References Cited

U.S. PATENT DOCUMENTS 1,816,140 A * 7/1931 Bain
2,551,574 A * 5/1951 Fredericks
3,150,510 A * 9/1964 Klopfenstein
3,702,228 A * 11/1972 Falck-Muus
3,871,815 A * 3/1975 Cangardel ..... 431/126

FOREIGN PATENT DOCUMENTS

CH 505197 A * 5/1971
DE 530147 C * 1/1927
WO 96/36685 * 11/1996

OTHER PUBLICATIONS

DE19539018C Abstract, Hoen, Aug. 22, 1996.*

DE 2850353A Abstract, E Spermas Decorativa, May 29, 1980.*

HU 9800577A Abstract, RUZ SonyI, Mar. 16, 1998.*

* cited by examiner

*Primary Examiner*—Margaret Medley
(74) *Attorney, Agent, or Firm*—James R. Williams

(57) ABSTRACT

The invention concerns a solid or liquid fuel composition capable while burning of producing a selected and varied colored flame other than the color of a standard flame. The composition comprises triethanolamine and a color-forming agent. The invention also concerns a candle or lighting device with a colored flame prepared from the composition. The invention further concerns a method for making a candle with a colored flame comprising the steps of casting the composition into a mold wherein a wick has previously been fixed, cooling the cast composition, and removing the cooled composition from the mold.

9 Claims, No Drawings

FUEL COMPOSITION PRODUCING A COLORED FLAME

FIELD OF THE INVENTION

The present invention relates to an article and method of producing a colored flame, wherein the article comprises a fuel material and a chromogenic agent.

DESCRIPTION

According to a first aspect, the invention relates to a solid or liquid fuel composition capable, while burning, of producing a selected and varied colored flame other than a standard or usual flame color. The present invention also concerns a candle or a lighting device with a colored flame prepared from the fuel composition. According to a third aspect, the present invention relates to a process for the manufacture of a colored flame candle.

The word "candle" is used to designate a functional or decorative lighting device comprising a wick, generally braided, embedded in a meltable fuel material capable, while burning, of producing a flame with a height generally between 2 and 4 cm. Usually, the meltable fuel material is comprised of waxes of various origins. A mixture of paraffin, stearin and, in minor amount, beeswax and mineral wax is typically used as meltable fuel material.

Commercial compositions often comprise major amounts of paraffin and stearin at 80–90 wt. % and 10–20 wt. % respectively. This composition improves the melting properties of the composition, improves compatibility between the various constituents, and avoids smoking during combustion.

During the melting of the meltable fuel material, occurring generally at a temperature between 60–80° C., the liquid mixture rises into the wick by capillary action and catches fire at the wick end. The flame temperature of a conventional candle is about 1000–1,200° C.

Various additives may be added to the meltable fuel material, for example, fluidity control agents to control the molten fuel material fluidity, and aromas or fragrance, such as incense.

For a long time, numerous efforts have been made to obtain a candle capable, while burning, of producing a colored flame other than a standard flame color. For example, it is known that ions of certain elements, including some metalloids having a sufficiently low excitation potential and most metals, radiate in the visible spectrum when they are in a gaseous phase and are in a sufficiently excited state. The combustion of such an element, or chromogenic agent, in a flame produces a characteristic color.

Chromogenic agents conventionally used for the preparation of a candle with a selected colored flame are, for example, derivatives of boric acid, copper or thallium compounds, etc. for a green colored flame, lithium or strontium compounds, etc. for a red colored flame, copper halides for a blue colored flame, sodium compounds for a yellow colored flame, lanthane compounds for an orange colored flame, etc.

U.S. Pat. No. 4,386,904, JP-Kokai-53-30,176, and JP-Kokoku-50-22,828 use a candle with a wick, which has been previously impregnated with a solution of an alkaline or alkaline-earth metal salt, oxide or hydroxide. Attempts have also been made to use a conventional meltable fuel material, such as wax, paraffin, fatty acid, etc., into which is added a chromogenic agent as a dust or powder of a metal, mineral salt, oxide or hydroxide (JP-Kokai-47-14,973), borate or perchlorate compounds dissolved in an ethanolamine derivative (U.S. Pat. No. 1,816,140, U.S. Pat. No. 2,551,574, U.S. Pat. No. 3,150,510 or DE-C-530,147) or, more recently, as a fatty acid salt.

Candles having a coating containing these various chromogenic agents were also disclosed. When the candle bums, the coating melts and releases theses chromogenic agents into the molten mixture in which the wick is imbedded.

None of these solutions is actually satisfactory because inhomogeneous distributions of these compositions do not allow a candle to produce a flame having a stable color. As indicated above, the temperature of a conventional candle flame is of about 1000–1200° C.; however, the inventors have observed that this temperature range is largely insufficient to excite conventional chromogenic agents. On the other hand, with a "hot" flame having a temperature higher than or of about 1,700° C., it was observed that these chromogenic agents could provide a colored flame fully satisfactory as to the obtained color.

Stemming from this principle, prior art discloses introducing a fuel component into the fuel composition that is able to increase the flame temperature. For example, French utility model application 2,675,813 teaches the use of hexamethylenetetramine to this end. It is also possible to find in the literature mention of the use of methaldehyde or hydrazine for the same purpose. Practically, these solutions are not satisfactory.

An acceptable candle must comprise a mixture that melts in a controlled way under the effect of heat. In other words, a crater of molten material must form at the candle surface at the level of the wick and its diameter must remain constant when the candle bums. If the crater diameter shrinks, the candle will eventually go out. If the crater diameter increases, the whole candle softens in a totally non-aesthetic manner. The crater diameter and consequently the quantity of molten material is controlled by the flame temperature, which itself depends on the composition of the mixture constituting the candle. Further, the molten mixture must rise into the wick by capillary action and catch fire at the wick end. For the flame of a burning candle to be stable, the speed of the molten material rising into the wick must balance the combustion rate of the same material in the flame. When the speed of the molten material rising into the wick is lower than the combustion rate, the flame rapidly runs out of fuel and eventually the wick itself burns. Consequently, the wick length shortens and the candle goes out. In the opposite situation, the fuel material arrives at the flame level in an amount such that the flame grows and comes down to the molten material crater level. The molten material eventually catches fire and the entire candle ignites.

Further, the molten material crater must contain a homogeneous mixture of the fuel composition, comprising, beside the conventional candle constituents, the chromogenic agent and the compound which, when burning, increases the flame temperature. The temperature of the molten material in the crater should ideally remain stable and be sufficient to ensure the fluidity of the molten material mixture so that it can rise into the wick by capillary action. On the other hand, at this temperature, the mixture must not be able to catch fire spontaneously; otherwise, the molten material crater could catch fire directly and ignite the entire candle.

According to the present invention, it is proposed to prepare a fuel composition capable, while burning, of producing a selected colored flame, by using a fuel composition comprising a chromogenic agent and triethanolamine. Conventional fuel constituents may comprise up to 50 wt. % of the fuel composition. Within the scope of the present invention, the chromogenic agent can be a mixture of several chromogenic agents.

The inventors note that triethanolamine can be used advantageously as a fuel component and is capable of increasing the flame temperature well above 1,700° C., which is a temperature sufficient to excite conventional chromogenic agents.

Further, and extremely advantageously, triethanolamine can entirely replace conventional waxes used as meltable fuel material, that is, unlike other above-mentioned fuel components capable of increasing the flame temperature, triethanolamine and a chromogenic agent can by themselves provide the fuel for the candle. Other conventional constituents, such as waxes, paraffin, etc., of the candle, if any, are present in a minor amount not greater than 50 wt. % and preferably below 20 wt. % of the composition. The very low cost of triethanolamine in comparison with conventional candle constituents, is not a negligible advantage.

Additionally, the inventors note that boric acid and its derivatives, the majority of the copper, thallium, tellurium, strontium, calcium, lanthane, sodium, etc. compounds or, more generally, mineral or organometallic compounds conventionally used as chromogenic agents are largely soluble in triethanolamine. Therefore, a fuel composition according to the invention is perfectly homogeneous at the time of its preparation for the manufacture of the candle, and consequently, the manufacture of the candle is simplified. Besides that, a homogeneous mixture is also obtained in the molten material crater when the candle is in use and consequently, the mixture, which rises into the wick by capillary action and which bums at the wick end, is also perfectly homogeneous. The chromogenic agent is therefore burnt at a constant rate and the produced color is stable and constant during the entire combustion.

One skilled in the art will easily determine compositions to prepare from the examples provided hereafter and from routine trials the proportions of the various constituents. Typically, a fuel composition according to the invention can comprise from 1 to 99% by weight of triethanolamine with the remainder being chromogenic agent. As indicated above, triethanolamine and a chromogenic agent alone can furnish the fuel composition according to the invention. However, it is advantageous that the composition also comprises stearin. The addition of stearin reduces smoking of the fuel while burning and improves melting of the fuel mixture.

One skilled in the art will also very easily determine the proportions of various constituents from the examples provided hereafter and from routine trials. Advantageously, a fuel composition according to the invention can comprise from 1 to 98% by weight of triethanolamine, up to 50% by weight of stearin, and the remainder of a chromogenic agent.

A further advantage of the triethanolamine is its compatibility with conventional wax constituents used in the candles. As above indicated, the fuel composition should be as homogeneous as possible. The present invention can produce a homogeneous mixture unlike solutions taught in the prior art.

Advantageously, the chromogenic agent is an ethanolamine derivative, such as triethanolamine borate if a green flame is desired. In this case, the chromogenic agent is infinitely soluble in the fuel composition and, by increasing the chromogenic agent's concentration, color intensity is markedly improved. Further, ethanolamine derivatives can burn without forming unaesthetic, black combustion residues around the molten material crater. When the chromogenic agent is a mixture of several chromogenic agents, one, several or all of them can be an ethanolamine derivative.

The fuel composition according to the present invention may be used in numerous applications, such as burning lamps, torches, etc. or, generally, as fuel for a lighting device comprising a tank and having a wick partially dipped into the tank, however, since initially it was designed for the manufacture of candles, its main use can be as a candle.

Such colored flame candles may be used during various ceremonies, parties or events for decorative or religious purposes. Accordingly, in another aspect, the invention relates to a colored flame candle characterized in that it consists essentially of a solid solution of triethanolamine and a chromogenic agent. All the compositions according to the invention can clearly be used for the manufacture of candles, the preferred compositions furnishing the preferred candles.

According to a final aspect, the invention relates to a process for the manufacture of a candle comprising the following steps:

(a) heating triethanolamine to a temperature between 53 and 100° C.;

(b) incorporating a chromogenic agent into the triethanolamine;

(c) optionally, incorporating stearin into the triethanolamine;

(d) pouring of the homogeneous mixture resulting from the two or three preceding steps, or more generally, of a composition according to the invention into a mold wherein a wick was previously attached;

(e) quenching of the molded composition into the mold; and (f) removal of a candle from the mold.

Steps (b) and (c) may be inverted or carried out simultaneously. Step (a), the heating of triethanolamine, can also be carried out before, at the same time as, or after steps (b) and (c) or according to any other combination. Given the slow dissolution rate of the chromogenic agent, which can take up to 6 hours, the sequence (a), then (b), and then (c) is preferred. Steps (b) and (c) are preferably carried out under stirring and heating until complete dissolution of the chromogenic agent and, if any, of the stearin.

The wick is a conventional large-size, braided wick. The quenching of step (e) can be performed according to conventional manners known by one skilled in the art such as dipping into a water bath, cooling in air, or simply storing at ambient temperature.

Optionally, the above-described process may comprise a further step (g) of dipping the candle, once removed from the mold, into a bath of liquid coating material. Preferably, the coating material consists essentially of stearin, optionally comprising a coloring agent according to the desired appearance of the candle.

According to a particular embodiment, the candle can comprise various aromas or fragrances well known by one skilled in the art, so that these aromas and fragrances are released into the atmosphere when the candle is burning.

According to another embodiment, the candle comprise several superimposed sections of different compositions (particularly as to the chromogenic agent) so that, when the candle is burning, the flame color changes.

EXAMPLES

Example 1

Green Colored Flame Candle

Eighty ml (90 g) of triethanolamine were introduced into a vessel placed in a beaker and the beaker was brought to between 80 and 95° C. Sixteen grams of boric acid were then added slowly under continuous stirring. Sixteen grams of stearin were then added, also slowly and under continuous stirring. The mixture so obtained was then poured, while hot, into a cylindrical mold wherein a braided, large-size wick was previously attached. The mold was cooled down by the surrounding atmosphere and the mold is removed.

This example was reproduced by progressively increasing the quantity of stearin up to 32 g. The candle consistency improved with increasing stearin; however, when the stearin amount neared 32 g, the green color of the flame became weaker.

Example 2

Green Colored Flame Candle

Eighty ml (90 g) of triethanolamine was introduced into a vessel placed in a beaker and the beaker was brought to between 80 and 95° C. Sixteen grams of triethanolamine borate were then added slowly under continuous stirring. Sixteen grams of stearin were then added, also slowly and under continuous stirring. The mixture so obtained was then poured, while hot, into a cylindrical mold wherein a braided, large-size wick was previously attached. The mold was cooled down by the surrounding atmosphere and the mold was removed.

Example 3

Green Colored Flame Candle with a Coating Layer

A candle was prepared as described in example 1 or 2, and was dipped into a molten stearin bath for 5 to 10 seconds and then cooled down.

Example 4

The wicks of the candle prepared at example 1 to 3 were lighted. The flame rapidly reached a stationary regime having a very stable, 2–4 cm flame. The flame had a sharp green color and its intensity was constant during the entire combustion of the candle. The combustion was regular and, during combustion, the molten material crater diameter did not increase or decrease.

What is claimed is:

1. A fuel capable, while burning, of producing a selected colored flame, consisting essentially of a major portion of up to 99 wt. % of triethanolamine; less than 50 wt. % of a wax selected from the group consisting of stearin, paraffin, beeswax, mineral wax and conventional candle wax; and at least one chromogenic agent.

2. The fuel of claim 1, wherein the fuel consists essentially of up to 98 wt. % triethanolamine, less than 20 wt. % stearin, and the remainder of at least one chromogenic agent.

3. The fuel of claim 1, wherein the chromogenic agent comprises an ethanolamine derivative.

4. The fuel of claim 3, wherein the chromogenic agent comprises triethanolamine borate.

5. A lighting device for producing a colored flame comprising a wick at least partially immersed in a fuel, where the fuel consists essentially of a major portion of up to 99 wt. % of triethanolamine; less than 50 wt. % of a wax selected from the group consisting of stearin, paraffin, beeswax, mineral wax and conventional candle wax; and at least one chromogenic agent.

6. The lighting device of claim 5, wherein the lighting device is a candle.

7. The lighting device of claim 5, wherein the fuel is held in a tank.

8. A process for manufacturing a candle that produces a colored flame consisting essentially of:

(a) heating a major portion of up to 99 wt. % of triethanolamine to a temperature between 53–100° C.;

(b) incorporating at least one chromogenic agent into triethanolamine to form a homogeneous mixture;

(c) pouring the homogeneous mixture into a mold wherein a wick was previously attached;

(d) quenching the mold; and (e) removing the quenched homogeneous mixture from the mold.

9. The process of claim 8, further including adding less than 50 wt. % of a wax selected from the group consisting of stearin, paraffin, beeswax, mineral wax and conventional candle wax, to the heated triethanolamine before pouring the homogeneous mixture into the mold.

* * * * *